US012391338B2

(12) United States Patent
Kapsaskis et al.

(10) Patent No.: US 12,391,338 B2
(45) **Date of Patent: *Aug. 19, 2025**

(54) BILGE SYSTEM

(71) Applicant: SEAFLO Marine & RV North America LLC, South Bend, IN (US)

(72) Inventors: Christopher Kapsaskis, Freehold, NJ (US); Joseph Cirillo, Manalapan, NJ (US); Zachary Grassi, Freehold, NJ (US); John Kosowski, Oak Brook, IL (US); Ye Yaoru, Xiamen (CN)

(73) Assignee: Seaflo Marine & RV North America, LLC, South Bend, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/241,931

(22) Filed: Sep. 4, 2023

(65) Prior Publication Data

US 2024/0208613 A1 Jun. 27, 2024

Related U.S. Application Data

(63) Continuation of application No. 16/442,041, filed on Jun. 14, 2019, now Pat. No. 11,745,830.

(51) Int. Cl.

| | |
|---|---|
| ***B63B 13/00*** | (2006.01) |
| ***B63J 4/00*** | (2006.01) |
| ***F04B 11/00*** | (2006.01) |
| ***F04B 43/02*** | (2006.01) |
| ***F04B 49/02*** | (2006.01) |
| ***F04D 13/08*** | (2006.01) |
| ***F04D 29/70*** | (2006.01) |

(52) U.S. Cl.

CPC ..... *B63B 13/00* (2013.01); *B63J 4/002* (2013.01); *F04B 11/0016* (2013.01); *F04B 43/02* (2013.01); *F04B 49/02* (2013.01); *F04D 29/708* (2013.01); *F04D 13/08* (2013.01)

(58) Field of Classification Search

CPC ..... B63B 13/00; F04B 43/02; F04B 11/0016; F04B 49/02; B63J 4/002; F04D 13/08; F04D 29/708

See application file for complete search history.

(56) References Cited

U.S. PATENT DOCUMENTS 2,977,922 A * 4/1961 Skovranek ..... B63B 13/00 417/297.5
3,007,430 A * 11/1961 Breneman ..... F03B 13/20 114/183 A
3,946,694 A * 3/1976 Belsky ..... F04B 53/1037 440/88 P (Continued)

*Primary Examiner* — Peter J Bertheaud
(74) *Attorney, Agent, or Firm* — Erickson Law Group, PC

(57) ABSTRACT

A bilge pump system for removing residual fluid from a vessel surface, includes at least one collection unit having a collection base with a collection inlet and a collection outlet, and a pump having a pump inlet flow-connected by at least one tube to the collection outlet. A discharge tube is flow-connected to the pump outlet, wherein the collection inlet comprises at least one opening on a bottom face of the collection base arranged to be on the vessel surface. A sponge is arranged within the opening of the collection base and in liquid communication with the vessel surface. The sponge can be fitted into place by lips or lugs protruding from the collection base.

14 Claims, 5 Drawing Sheets

(56) References Cited

U.S. PATENT DOCUMENTS

| | | | | |
|---|---|---|---|---|
| 6,837,174 | B1 * | 1/2005 | Baurley | F04F 1/02<br>114/183 R |
| 11,745,830 | B2 * | 9/2023 | Kapsaskis | F04B 53/005<br>114/183 R |

* cited by examiner

BILGE SYSTEM

This application is a continuation of US Ser. No. 16/442,041, filed Jun. 14, 2019.

BACKGROUND

Vessels, such as boats or ships can have a bilge pump for removing water collecting on a bottom of the vessel. However, most bilge pumps are impeller pumps which are flooded suction pumps, and leave a residual amount of water in the compartment. This residual water can lead to mold, mildew, mustiness, odors, rot and can affect hull integrity.

U.S. Pat. No. 6,837,174 discloses a pneumatic bilge liquid removal system including an air compressor having inlet and outlet ports pneumatically coupled to a valve system. The air compressor pressurizes a collection chamber via the outlet port causing the bilge liquid in the collection chamber to discharge through the discharge tube. Then, the air compressor creates a negative pressure in the collection chamber via the inlet port causing any bilge liquid to be drawn into and accumulate in the collection chamber via collection tubes. This is a somewhat complicated system that requires an air compressor, a controlled valve system and a collection chamber.

The present inventors have realized that it would be desirable to provide a bilge pump system that is useful to empty the residual amount of water in a boat's bilge, or other water containing compartments.

The present inventors have recognized the desirability to provide such a bilge pump system that did not have the drawbacks of the prior systems, is cost effectively manufactured, and is more easily operated and maintained.

SUMMARY

The exemplary embodiments of the invention provide a bilge pump system for removing residual fluid from a vessel surface, including at least one collection unit having a collection base with a collection inlet and a collection outlet, and a pump having a pump inlet flow-connected by at least one tube to the collection outlet. A discharge tube is flow-connected to the pump outlet, wherein the collection inlet comprises at least one opening on a bottom face of the collection base arranged to be on the vessel surface.

The bilge pump system advantageously includes a sponge arranged within the opening of the collection base and in liquid communication with the vessel surface. The sponge can be fitted into place by lips or lugs protruding from the collection base.

The collection base can include a check valve to prevent backflow into the collection base.

The pump can advantageously be a diaphragm pump.

A user-programmable timer switch can be used to turn on and off the pump.

A single pump can be flow connected to multiple collection units. A control valve can be arranged between each collection unit and the pump inlet. The control valve can be pneumatic, electric, or a solenoid valve.

The embodiments of the present invention provide a residual bilge pump system that is effective to remove residual liquid from a vessel beyond that which is removed by a primary bilge pump. For example, the embodiment of the present invention provides a residual bilge pump system that is effective to remove residual water from a boat or ship beyond that which is removed by a primary bilge pump.

The embodiments of the present invention can use a diaphragm pump activated by a user-programmable timer to evacuate the residual amount of bilge water, through a small diameter tube connected to a suction foot attached to a weighted collection base incorporating a sponge. The small diameter tube is connected to a suction unit. The suction unit uses a self-priming diaphragm pump to suction the liquid entering the collection base into the small diameter tube to be discharged. The suction unit can suction from a great distance away from the collection base.

Advantageously the timer is built into the suction unit. This allows the user to activate the pump for as many minutes as desired. For example a user can select as many as 16 activations a day, to as little as one activation per week. This allow the user to custom tailor activation to their vessel's need. The timer can be hidden behind a water-tight lid with an o-ring gasket. This suction unit can discharge residual water overboard via a thru hull, or discharge the residual water into a holding container.

Numerous other advantages and features of the present invention will become readily apparent from the following detailed description of the invention and the embodiments thereof, from the claims and from the accompanying drawings.

DETAILED DESCRIPTION

Figure 1:
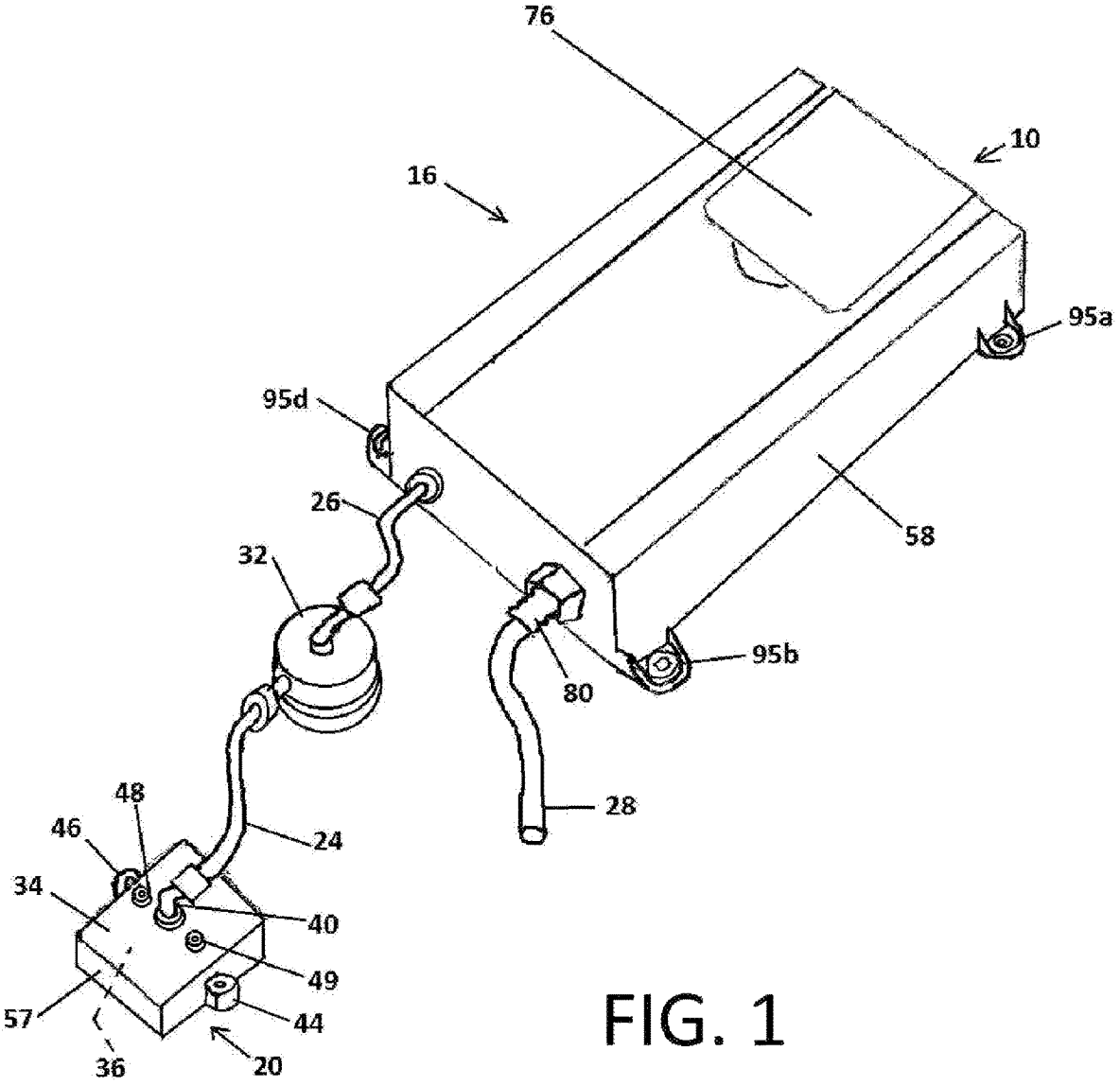
FIG. 1 is a perspective view of a bilge pump system according to an embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference US Ser. No. 16/442,041, filed Jun. 14, 2019, in its entirety.

FIGS. 1-4 illustrate one embodiment of a bilge pump system 10 according to the invention. The system includes a suction unit 16, connected to a collection unit 20, by suction tubes 24, 26. The suction unit 16 is connected to a discharge tube 28. A pneumatic, electric, or solenoid operated valve 32 can be flow connected between the suction tubes 24, 26. The solenoid valve is useful if more than one collection unit 20 is used. For one collection unit 20, the solenoid valve can be eliminated and a single suction tube 24 can connect the collection unit 20 to the suction unit 16.

The collection unit 20 includes a collection base 34 with a weight 36 built in (encapsulated in ultrasonically welded plastic) to help hold the base down onto the floor if it is not attached. The top of the collection base 34 can use a "¼" PUSH FIT" fitting 40, which allows the suction tube 24, such as a ¼" tube, to easily be installed onto the collection base 34 by just forcing it in with a user's hand, without need for a tool. The collection base can also incorporates a check-valve 42. The check valve 42 ensures liquid that has moved past the collection base, does not drip back down into the collection base. The base also incorporates two lugs 44, 46 with holes which allows for screw-down mounting of the base. The collection base also incorporates two bosses 48, 49 that each accept a screw, for different attaching methods and brackets for securing the collection base.

A strainer 52 is used to catch any debris that may have made it past the collection base, and prevents debris from being sucked into the suction unit 16, preventing damage. The suction tubes can use "¼" PUSH FIT" fittings, which allows ¼" line to easily be installed onto the strainer by just forcing it in by hand without the need for a tool.

The collection base 34 has an open bottom face 54 that is closed by a sponge 56. The sponge can be held in place in the base 34 by lugs or lips 51, 52 protruding inward from the base. The sponge enhances the collection of water or other fluid that otherwise would be very shallow on the vessel surface. The base has peripheral holes 57 exposing the sponge to allow water to reach the sponge.

Figure 2:
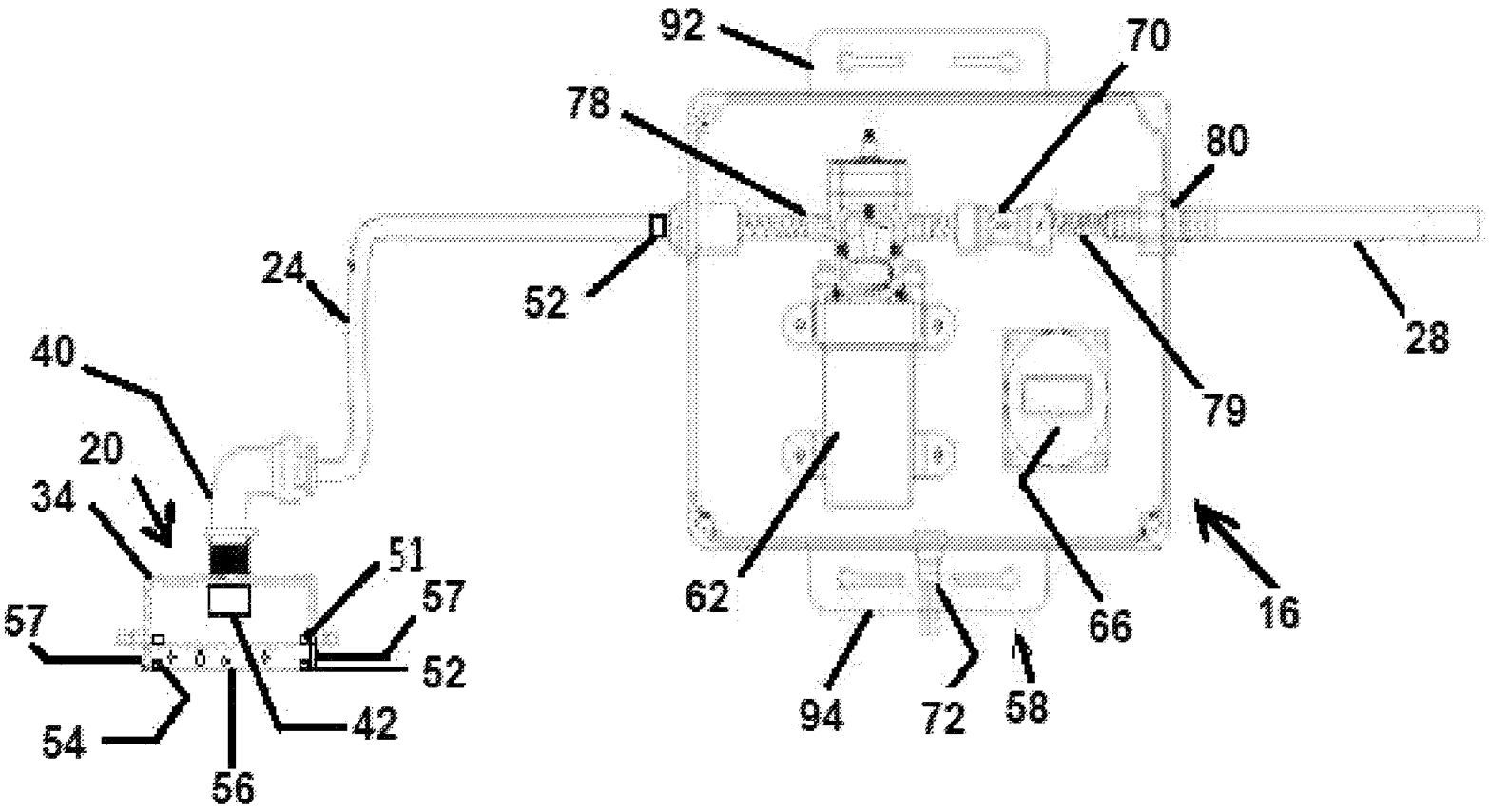
FIG. 2 is a schematic view of the system shown in FIG. 1.
Figure 3:
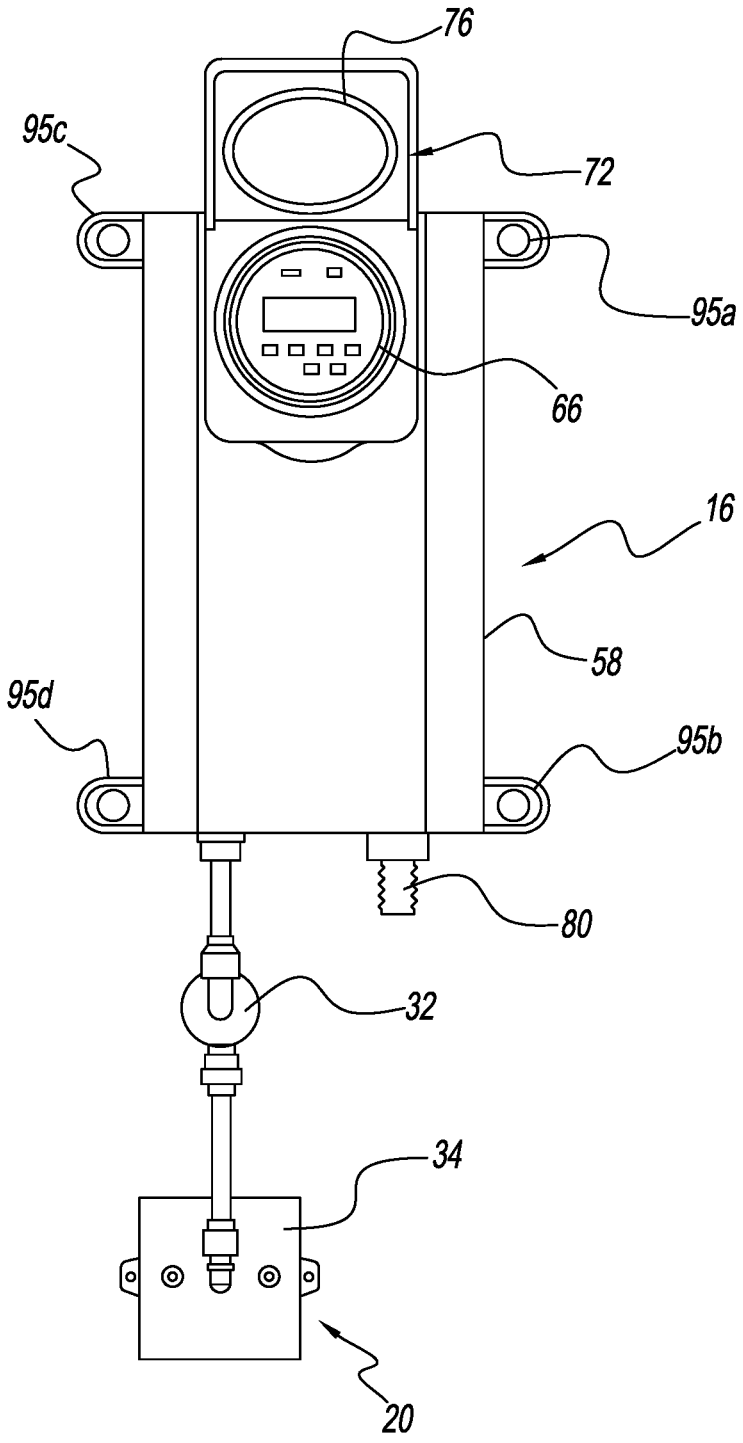
FIG. 3 is a plan view of the system shown in FIG. 1.
Figure 4:
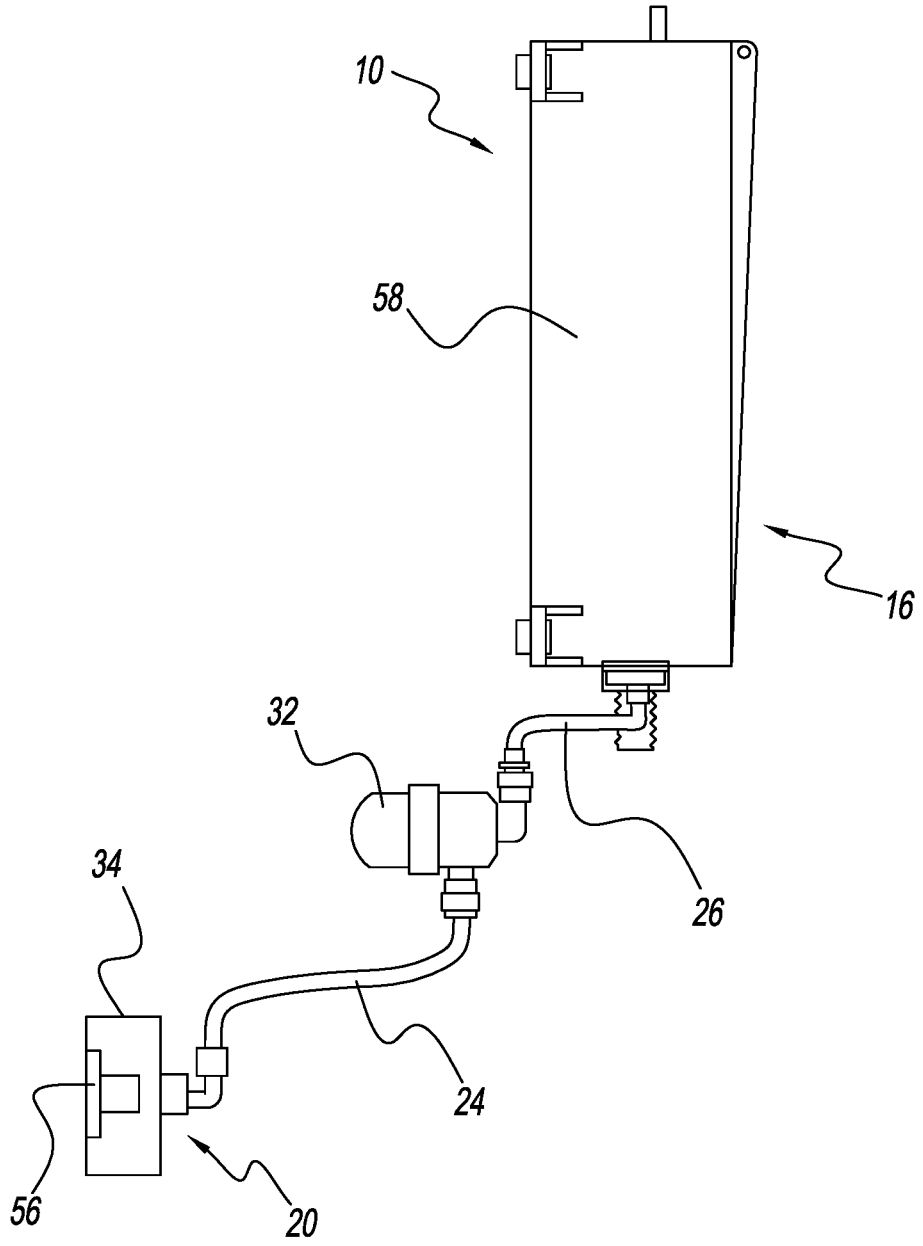
FIG. 4 is an elevation view of the system shown in FIG. 1, taken from line 4-4 of FIG. 3.

The suction unit 16 shown in FIG. 2 includes a housing 58 containing a self-priming diaphragm pump 62, a timer 66, a check valve 70, an electrical connection 72 for the pump 62, an internal suction tube 78 and an internal discharge tube 79. The pump 62 suctions the liquid entering the collection base 34 through the sponge 56, through the check valve 42, through the suction tubes 24, 26 and solenoid valve 32 if present, through the strainer 52, through the internal suction tube 78, through the pump 62, through the internal discharge tube 79 and the check valve 70, through the outlet 80, and through the discharge tube 28 to an external collection location to be disposed of or collected. The housing 58 can includes flanges 92, 94 (FIG. 2) having screw holes for attaching the housing to a floor or wall or bracket or four feet 95*a*, 95*b*, 95*c*, 95*d* (FIGS. 1, 3 and 4) with screw holes for attaching the housing to a floor or wall or bracket.

The suction unit 16 can be configured to effectively suction liquid from the collection base 34 from over 25 feet away from the collection base 34. The diaphragm pump 62 can be activated by a timer 66 that can be built into the unit 16. This timer is user-programmable. This allows the user to activate the pump 62 for as many minutes as desired, such as 16 activations a day, to as little as one activation per week. This allows the user to custom tailor activation to their vessel's need. This timer 66 can be hidden behind a watertight lid 72 with a o-ring gasket 76. A discharge outlet 80 of the unit 16 can be a ½" barbed fitting connected to the discharge tube 28, which can be a ½ inch tube. The tube 28 can be discharged overboard via a thru hull, collected into a holding container, or otherwise removed from the vessel floor.

Figure 5:
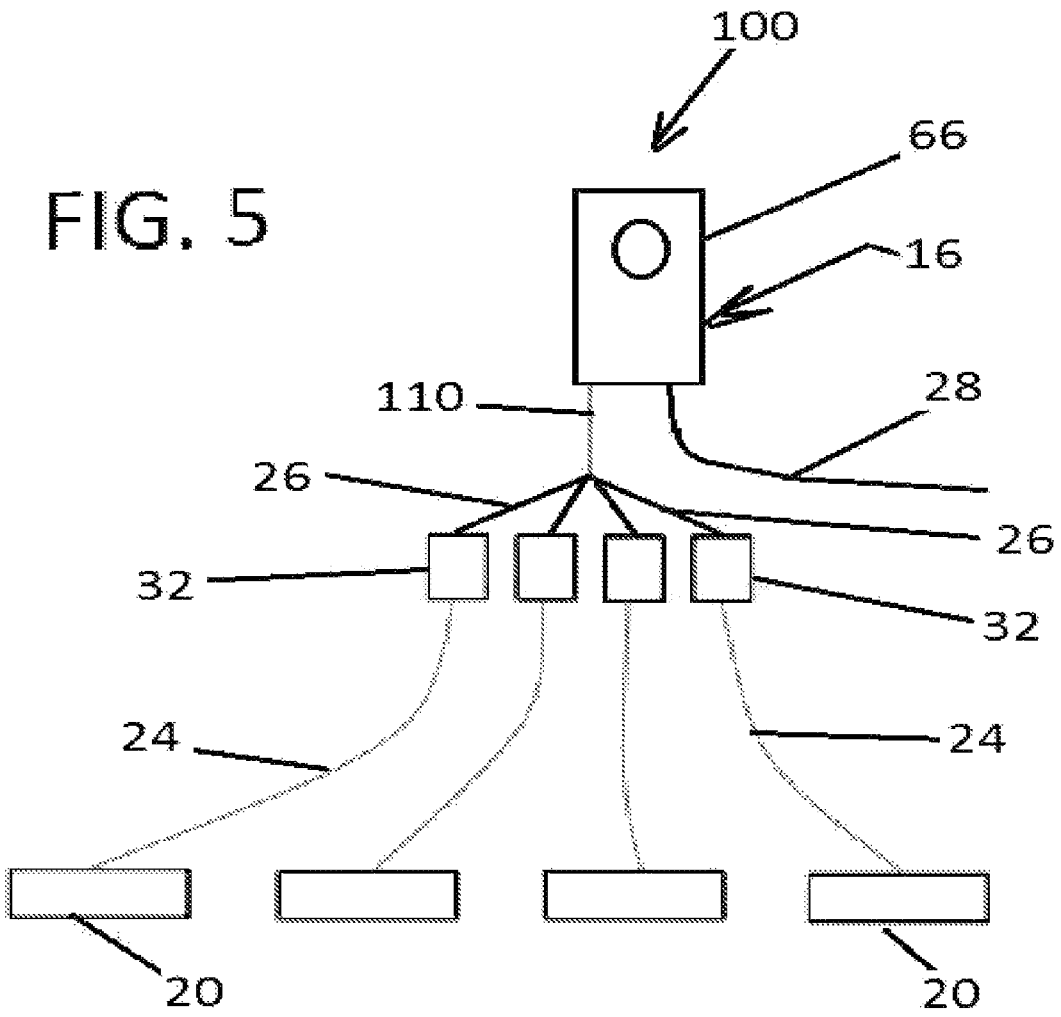
FIG. 5 is a schematic view of an alternate bilge pump system according to an alternate embodiment of the invention.

FIG. 5 illustrates an enhanced system 100 wherein multiple suction tubes 26 (four shown) are connected to a manifold 110 that is connected to multiple pneumatic, electric, or solenoid operated valves 32 (four shown) that are connected to multiple suction tubes 24 (four shown), each tube connected to a collection unit 20 (four shown). In this way, different surfaces of a vessel that are likely to collect water or other fluid can be serviced by plural collection units 20 and only one suction unit 16. The solenoid operated valves 32 can be controlled to connect suction to one collection unit 20 at a time, or combinations of collection units 20 at a time.

From the foregoing, it will be observed that numerous variations and modifications may be effected without departing from the spirit and scope of the invention. It is to be understood that no limitation with respect to the specific apparatus illustrated herein is intended or should be inferred. US

The invention claimed is:

1. A bilge pump system for removing residual fluid from a vessel surface, comprising:

a collection unit having a collection base with a collection inlet and a collection outlet, an electrically-driven diaphragm pump having a pump inlet flow-connected by at least one tube to the collection outlet, a pump outlet, and a discharge tube flow-connected to the pump outlet, wherein the collection inlet comprises at least one opening on a bottom face of the collection base arranged to be on the vessel surface, and a user-programmable timer to control operation of the electrically-driven diaphragm pump.

2. The bilge pump system according to claim 1, comprising a sponge arranged within the at least one opening of the collection base.

3. The bilge pump system according to claim 2, wherein the sponge is fitted into place by lips or lugs protruding from the collection base.

4. The bilge pump system according to claim 1, wherein the at least one opening comprises a plurality of openings.

5. The bilge pump system according to claim 1, wherein the collection base is weighted.

6. The bilge pump system according to claim 1, wherein the at least one tube between the pump inlet and the outlet of the collection base is affixed with at least one push fit fitting.

7. The bilge pump system according to claim 1, wherein the collection base includes a check valve to prevent backflow into the collection base.

8. The bilge pump system according to claim 1, comprising an inline strainer upstream of the pump inlet to avoid clogging the pump.

9. The bilge pump system according to claim 1, comprising a timer switch in signal communication with the user-programmable timer to turn on and off the pump.

10. The bilge pump system according to claim 1, comprising pneumatic, electric, or solenoid valves, and at least one second collection unit having a second collection base with a second collection inlet and a second collection outlet, the diaphragm pump inlet flow-connected by at least one second tube to the second collection outlet, wherein the second collection inlet comprises at least one second opening on a second bottom face of the second collection base arranged to be on the vessel surface; wherein one of said pneumatic, electric or solenoid valves is flow-connected between the pump inlet and the first collection inlet and between the pump inlet and the second collection inlet in order to select flow from either or both of the first and second collection units.

11. The bilge pump according to claim 1, wherein the pump is enclosed by a housing and the housing also encloses the user-programmable timer.

12. The bilge pump according to claim 11, wherein the housing includes screw-holding protrusions to fasten the housing to an external surface.

13. The bilge pump according to claim 1, comprising multiple collection units, each collection unit having a collection base with a collection inlet and a collection outlet, the pump inlet flow-connected by multiple tubes to the collection outlets, wherein each collection inlet comprises at least one opening on a bottom face of the collection base arranged to be on the vessel surface.

14. The bilge pump according to claim 13, further comprising controllable valves each flow connected between the pump inlet and one collection outlet.

* * * * *